US006718792B1

(12) United States Patent
Sarkisian et al.

(10) Patent No.: US 6,718,792 B1
(45) Date of Patent: Apr. 13, 2004

(54) INTEGRATED AQUA-AMMONIA CHILLER/HEATER

(75) Inventors: Paul Sarkisian, Boulder City, NV (US); Uwe Rockenfeller, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 0 days.

(21) Appl. No.: 09/479,277

(22) Filed: Jan. 5, 2000

(51) Int. Cl.[7] ..... F25B 13/00
(52) U.S. Cl. ..... 62/324.2; 62/476; 62/485
(58) Field of Search ..... 62/324.2, 476, 62/485

(56) References Cited

U.S. PATENT DOCUMENTS

| | | | | |
|---|---|---|---|---|
| 4,178,989 A | | 12/1979 | Takeshita et al. | 165/62 |
| 4,646,541 A | | 3/1987 | Reid, Jr. et al. | 62/476 |
| 5,282,369 A | | 2/1994 | Ohuchi et al. | 62/476 |
| 5,363,668 A | | 11/1994 | Nakao et al. | 362/141 |
| 5,367,884 A | | 11/1994 | Phillips et al. | |
| 5,490,393 A | | 2/1996 | Fuesting et al. | |
| 5,517,830 A | * | 5/1996 | Ohuchi et al. | 62/476 |
| 5,548,971 A | | 8/1996 | Rockenfeller et al. | |
| 5,617,733 A | | 4/1997 | Tomita et al. | 62/324.2 |
| 5,794,456 A | | 8/1998 | Ishiguro et al. | 62/497 |
| 5,799,502 A | | 9/1998 | Nomura et al. | 62/476 |
| 5,878,587 A | * | 3/1999 | Kojima et al. | 62/148 |
| 6,047,559 A | * | 4/2000 | Tanaka et al. | 62/476 |
| 6,101,832 A | * | 8/2000 | Franz et al. | 62/324.2 |
| 6,250,089 B1 | * | 6/2001 | Serpente et al. | 62/101 |

OTHER PUBLICATIONS

Modahl, R. J., et al,. "Evaluation of a Commercial Advanced Absorption Heat Pump Breadboard", pp. 117–125 (1988).

* cited by examiner

*Primary Examiner*—William Doerrler
(74) *Attorney, Agent, or Firm*—Knobbe, Martens, Olson & Bear, LLP

(57) ABSTRACT

An aqua-ammonia chiller apparatus is modified to include a heater function by providing a refrigerant by-pass for directing refrigerant to a heat exchanger capable of selectively functioning as a condenser during a heating mode or an evaporation during a cooling mode without passing through the apparatus condenser during the heating mode.

72 Claims, 8 Drawing Sheets

INTEGRATED AQUA-AMMONIA CHILLER/HEATER

BACKGROUND OF THE INVENTION

Liquid/vapor absorption systems using ammonia refrigerant, often referred to as aqua-ammonia systems, are well-known in the art. These systems utilize absorber heat exchange or generator/absorber heat exchange (GAX) cycles carried out in absorption refrigeration chillers for supplying cooling, typically in the form of a chilled water supply directed to a hydronic loop cooperating with an indoor coil and other heat exchange components for transferring the cooling effect to the space to be conditioned. The basic components of such a chiller apparatus include an absorber, generator, condenser and evaporator and necessary piping for the ammonia refrigerant and the water-based absorption fluid. The heat to the generator is supplied by a burner, and a circulating pump is required for directing the absorption fluid through the apparatus components.

When heating for the conditioned space is required, a separate water heater and tank or a furnace are used. Where the cooling and heating functions are combined in a chiller/heater assembly, two separate burners are used, one for cooling and one for the heating, and separate pumps are required for the two different hydronic loop functions.

SUMMARY OF THE INVENTION

The present invention is directed to an improved and simplified aqua-ammonia absorption apparatus in which the cooling and heating functions are integrated into a single apparatus requiring only one burner for heating the generator and one pump for directing the fluid through the hydronic loop system. The basic apparatus components are an absorber, a generator, condenser, a heat exchanger capable of functioning as both a condenser and an evaporator, and refrigerant by-pass conduit and valving to provide selective by-pass of the refrigerant from the generator to the heat exchanger without passing through the condenser. In the cooling mode or function, the heat exchanger functions as an evaporator. During a heating mode, the refrigerant from the generator by-passes the condenser and is directed to the heat exchanger which functions as the condenser to provide heat which is recovered for heating a conditioned space, water heating, etc. A detailed description of the apparatus components and operation, as well as the advantages of the invention will be described hereinafter.

DETAILED DESCRIPTION OF THE PREFERRED EMBODIMENT

Figure 1A:
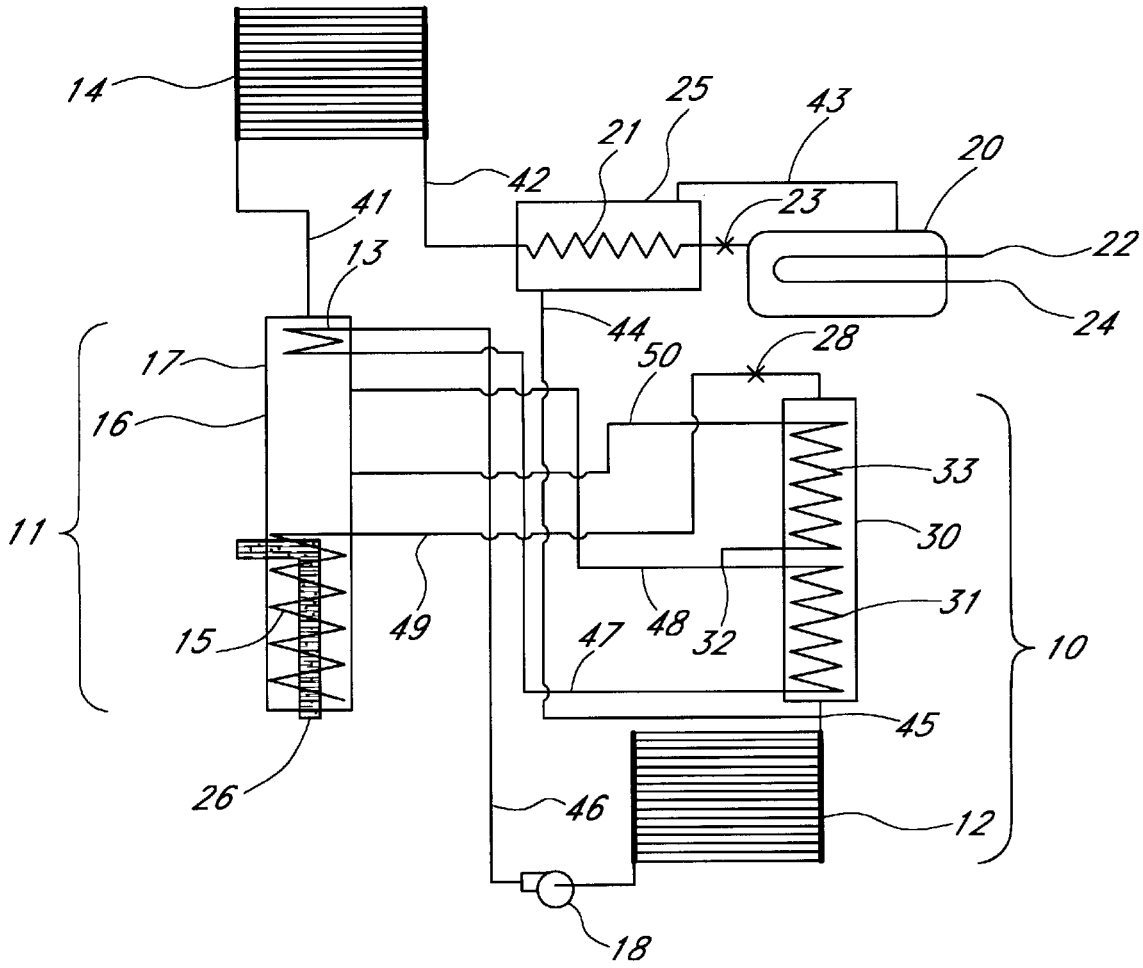
FIGS. 1A–1D schematically illustrate different embodiments of conventional GAX liquid-vapor absorption chillers.

FIG. 1A schematically illustrates a conventional aqua-ammonia GAX (generator absorber heat-exchange) chiller system. The major components of the chiller system include an absorber assembly 10 comprising an absorber 12 and an absorber heat exchange section 30 which includes an absorber heat exchanger 31, sometimes referred to as "HCA" or "SCA," and a GAX heat exchanger 33. A generator assembly 11 includes a generator heat exchanger 15, a boiler 26 having a burner for heating and vaporizing the refrigerant, an adiabatic section 16, and a rectifier section 17. The burner may be of a multiple or variable capacity type, and may include a combustion air pre-heater. The use of variable or multiple capacity burners may be especially desirable in an apparatus of the invention to meet the different energy input levels needed for different cooling and heating function requirements of the chiller/heater. A condenser 14 and an evaporator 20 are the other major components of the system. The chiller system illustrated also includes a subcooler 25 for precooling refrigerant from the condenser with cold gaseous refrigerant from the evaporator. The absorber 12 and condenser 14 heat exchangers may be air or water cooled, whereas the rectifier 17 may be cooled by solution or water. Such a conventional GAX chiller is well-known in the art, for example, U.S. Pat. Nos. 5,490,393 and 5,367,884, and in Modahl et al., "Evaluation of a Commercial Advanced Absorption Heat Pump Breadboard," 1988, the descriptions of which are incorporated herein by reference.

During operation of the conventional GAX chiller illustrated absorption fluid is pumped from the absorber 12. The refrigerant rich absorption fluid solution is pumped via pipe 46 to reflux coil 13 within rectifier 17 after which it is directed via pipe 47 to the absorber heat exchanger 31 and GAX heat exchanger 33. In the embodiment shown, a flow splitter 32 splits the absorption fluid passing from absorber heat exchanger 31, a first portion to the generator via pipe 48, and a second portion to GAX heat exchanger 33 and to the adiabatic section of the generator via pipe 50. The advantages of a GAX system over a conventional absorber heat exchange (AHE) system with flow split of a portion of the rich absorption fluid through the GAX heat exchanger are discussed in more detail in the aforesaid incorporated prior art disclosures, particularly in the Modahl et al. publication and the '884 patent. The present invention is not limited to the use of a GAX system and may use a conventional absorber heat exchange system, although the more efficient GAX cycle is preferred.

Refrigerant vapor generated in generator assembly 11 is directed to condenser 14 via pipe 41, and from the condenser to the subcooler 25 via pipe 42. In the subcooler heat exchanger 21, the condensed refrigerant is subcooled by exposure to cold gaseous refrigerant from the evaporator 20 via pipe 43. The condensed refrigerant then passes through expansion valve 23 to evaporator 20 where it evaporates to cool water or other heat transfer fluid supplied via return line 22. Chilled water or other heat transfer fluid is supplied to a load for cooling a conditioned space via supply pipe 24. The refrigerant vapor from subcooler 25 is directed via pipes 44 and 45 to the absorber assembly 10. Weak solution from the generator via pipe 49 and through throttling device 28 is directed to the absorber assembly 10. As the weak solution from the generator passes through the GAX heat exchanger 33 and the absorber heat exchanger 31, it absorbs refrigerant vapor. Although the drawing shows pipe 44 communicating with pipe 45 downstream from heat exchange section 30, it may instead introduce refrigerant vapor into the lower portion of the heat exchange section 30, preferably near the bottom. Such a feature also applies to the embodiments shown and described in FIGS. 2–5.

Figure 1B:
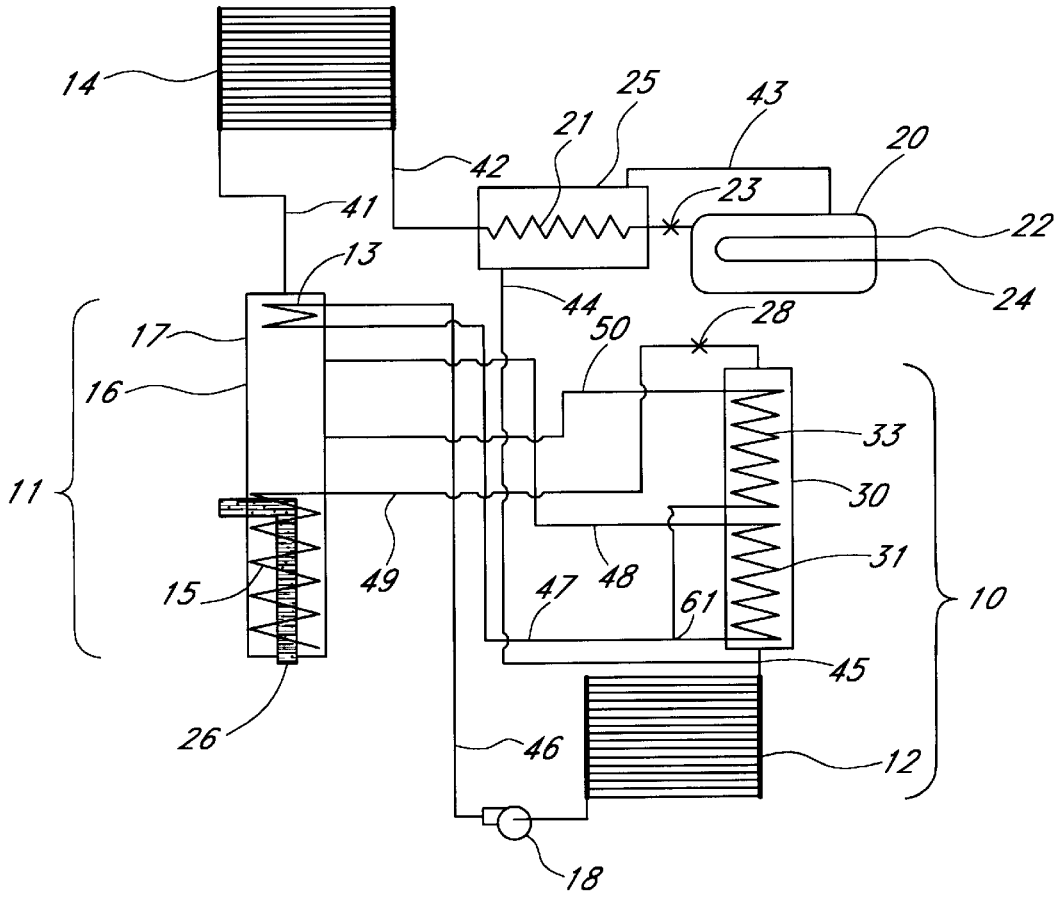
Figure 1C:
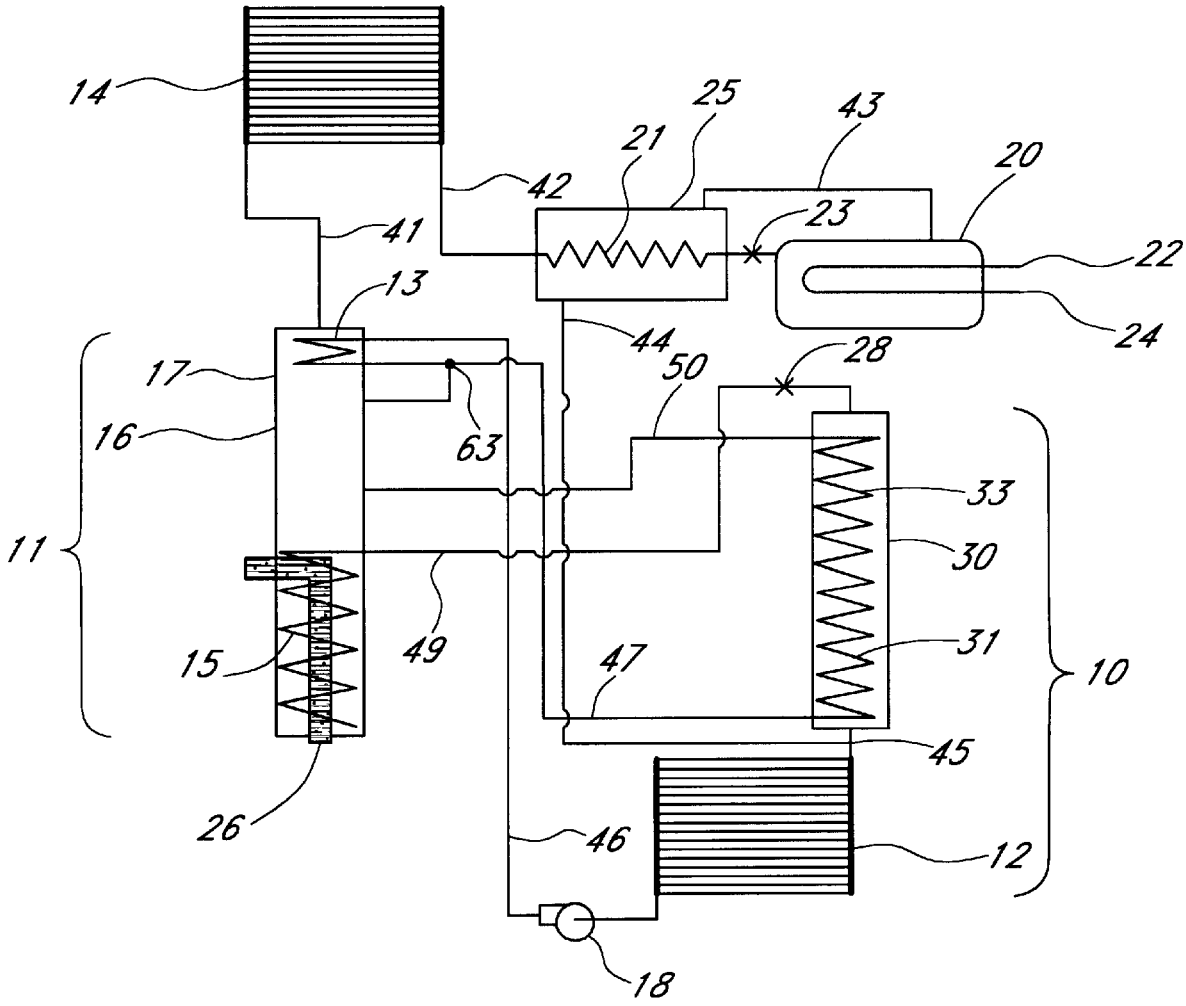

FIGS. 1B and 1C illustrate different routing of the rich absorption fluid, often referred to as rich liquor, used in such GAX heat exchange systems. In FIG. 1B, flow splitter 61 divides the rich fluid flow in parallel between the absorber heat exchanger 31 and GAX heat exchanger 33, splitting the solution flow before it reaches the absorber heat exchanger. In FIG. 1C flow splitter 63 divides the rich liquor before the absorber heat exchanger, a first portion flowing to the adiabatic section of the generator and a second portion going to the absorber heat exchanger.

Figure 1D:
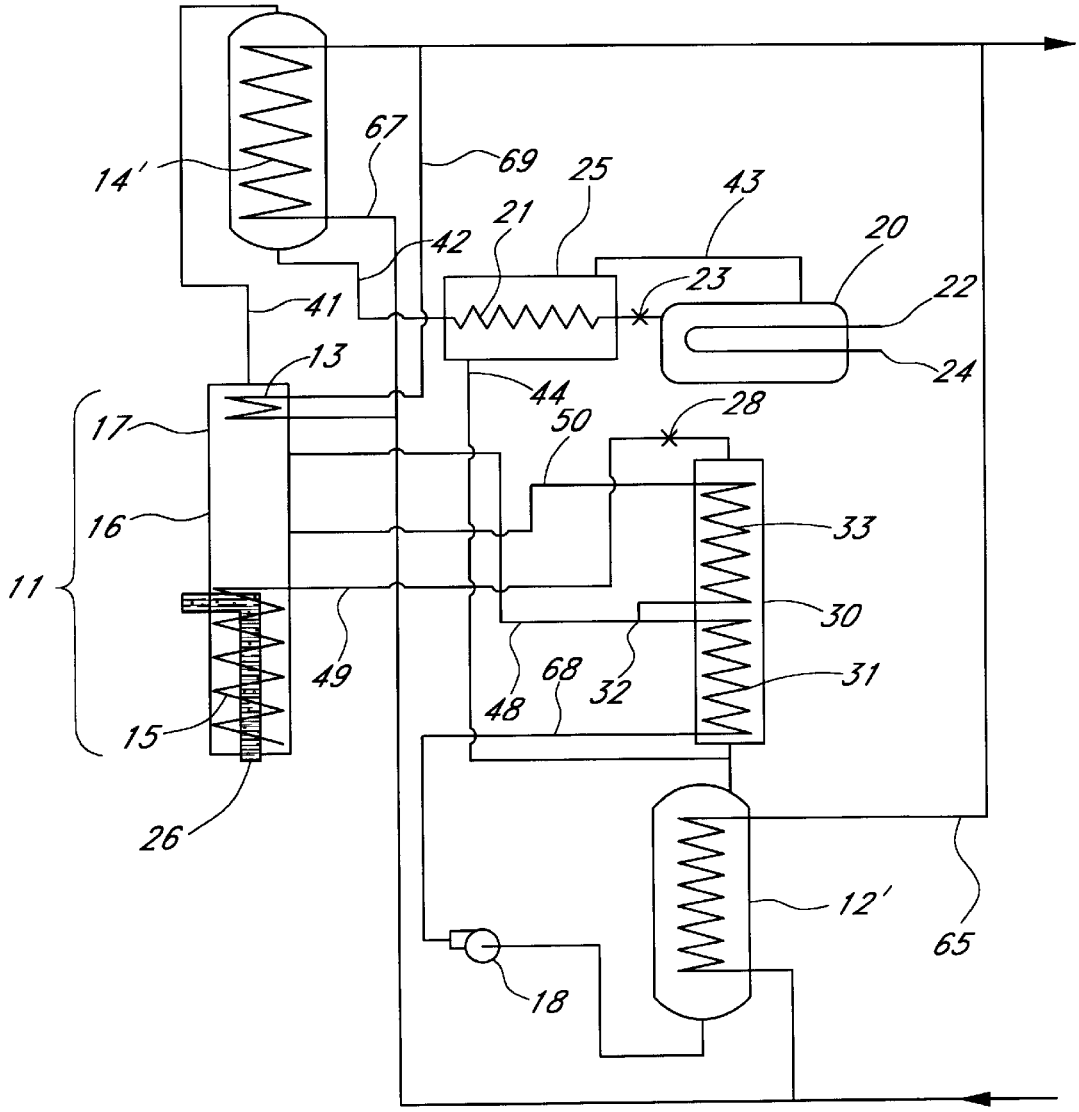

FIG. 1D schematically illustrates a hydronically-cooled GAX aqua-ammonia chiller of the type shown in FIG. 1A. Thus, the absorber 12 and condenser 14 are water cooled as is the rectifier 17. Cooling water is routed in parallel to the absorber, condenser and rectifier via conduits 65, 67 and 69. However, this could also be circuited in series, or in a combination of series, parallel, if desired.

Conventional chiller apparatus of the GAX types illustrated in FIGS. 1A–1D or a simple absorber heat exchange system provides a chilled water supply to an indoor coil in a conditioned space via a hydronic loop that usually includes antifreeze/water solutions as a heat exchange fluid. With conventional systems, to provide heat a separate boiler and/or a furnace is required. In the present invention, a conventional chiller apparatus is modified to create an integrated heater function using substantially the same conventional chiller components. The resulting apparatus produces useful heat for space conditioning without the need for an auxiliary furnace or boiler.

Figure 2:
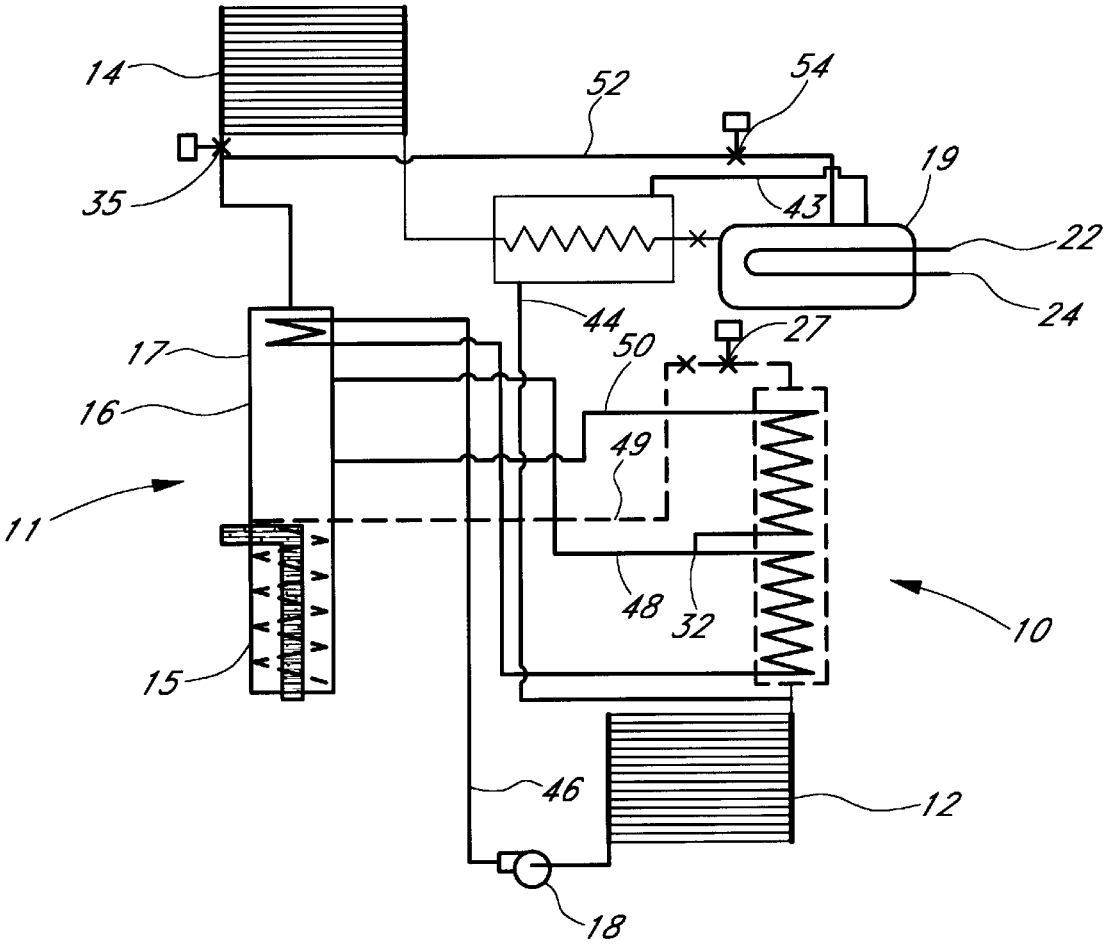
FIG. 2 is a schematic illustration of a GAX chiller/heater of the invention showing the refrigerant condenser by-pass in a heating mode.

Referring to FIG. 2, a GAX chiller/heater system of the present invention is illustrated. In the drawing, the necessary operating components used in a heating mode are shown in bold with the optional components shown in dashed lines. In the heating mode embodiment shown, refrigerant is returned to the generator using the solution pump 18. An important feature of the apparatus of the invention includes a by-pass pipe 52 for directing the refrigerant from the generator assembly 16 to a dual function heat exchanger 19 without passing through condenser 14. Also included is operated valve 35 for shut-off of refrigerant flow from the generator to the condenser 14. Solenoid operated valve 54 selectively opens and closes the pipe 52. To provide a heating function, refrigerant vapor from the generator assembly passes to heat exchanger 19 which acts as a condenser to supply heat to the water return and supply pipes 22 and 24 respectively. Condensed refrigerant from the heat exchanger is directed to the absorber 12 via pipes 43 and 44. The refrigerant enriched absorption fluid solution from the absorber is pumped to the reflux coil 13 in rectifier section 17 and through the GAX absorber assembly components as previously described. To return to a chiller operation, valve 54 is closed whereby the system functions as described for FIGS. 1A–1D. A solenoid operated valve 27 is also illustrated along with solution pipe 49 for selectively controlling solution flow to the absorber assembly.

Figure 3:
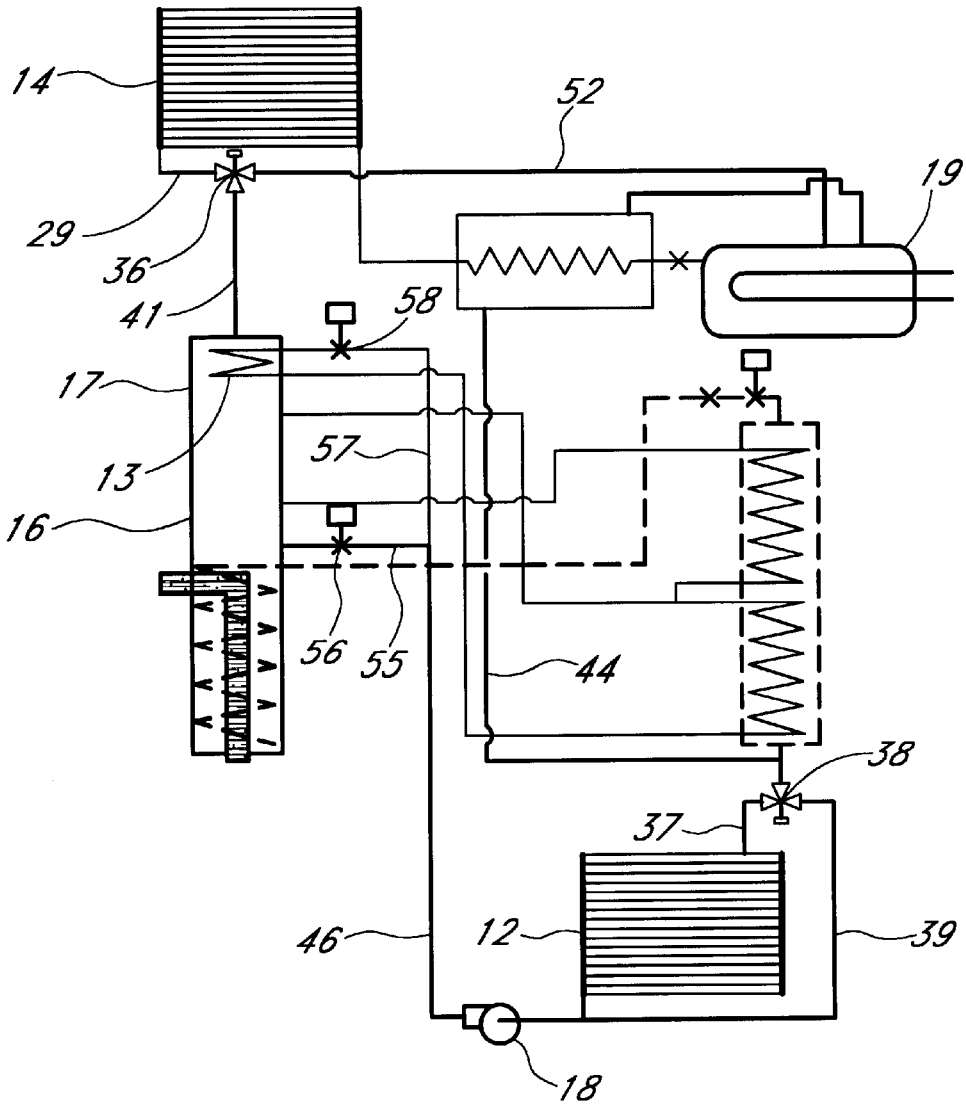
FIG. 3 is another illustration of a GAX chiller/heater of the invention showing alternative embodiments using 3-way valves for directing refrigerant-condenser by-pass and solution-absorber by-pass.

FIG. 3 illustrates an alternative embodiment of the chiller/heater system of the invention. The embodiment also illustrates functioning components and piping in bold used in a heating mode including pumped return of the refrigerant to the generator with the rich solution where gravity return is not possible, or is otherwise not desired. The embodiment shown in FIG. 3 incorporates 3-way valves for directing refrigerant and/or solutions for by-passing the condenser and/or the absorber. The embodiment shown also uses solenoid operated valves 56 and 58 for selectively opening and closing the pipes that direct absorption fluid to the generator assembly. These solenoid valves may be operated independently of 3-way valve 36 which is used for selectively directing refrigerant vapor to dual function heat exchanger 19 via pipe 52 to provide a heating function, or to condenser 14 via pipe 29 when it is desired to condense refrigerant in condenser 14 with heat exchanger 19 functioning as an evaporator in a cooling mode. The use of 3-way valve 36 eliminates the need for solenoid valve 54 for opening and closing pipe 52 shown in FIG. 2. However, the solenoid valve 54 may be used as an alternative to the 3-way valve 36 if required by code.

In the absorption fluid loop, the embodiment shown in FIG. 3 uses pipe 55 which branches or tees from pipe 46 to direct absorption fluid to the generator assembly 16, and a solenoid operated valve 56 to selectively open and close pipe 55. Pipe section 57 is an extension of pipe 46 for directing the absorption solution to reflux coil 13 of rectifier 17. Solenoid operated valve 58 selectively opens and closes the pipe portion 57. By opening valve 56 and closing valve 58, absorption solution to the rectifier and to the absorber heat exchanger 31 and GAX heat exchanger 33 may be stopped. By closing valve 58 and opening valve 56, the absorption solution is pumped directly from absorber 12 to the generator 16 where it is vaporized and directed via by-pass pipe 52 to the heat exchanger 19 acting as a condenser for supplying heating to a conditioned space or load. Thus, this simplified system embodiment avoids the use of the GAX portion of the system previously described. With the refrigerant by-pass pipe 52 open, use of a condenser cooling fan is not required.

In FIG. 3, a 3-way valve 38 is also shown for selectively by-passing the absorber 12. The 3-way valve 38 may be selectively operated for directing refrigerant containing solution to the absorber 12 via pipe 37 or by-passing the absorber via pipe 39. By-passing the absorber also avoids the use of an absorber cooling fan.

Figure 4:
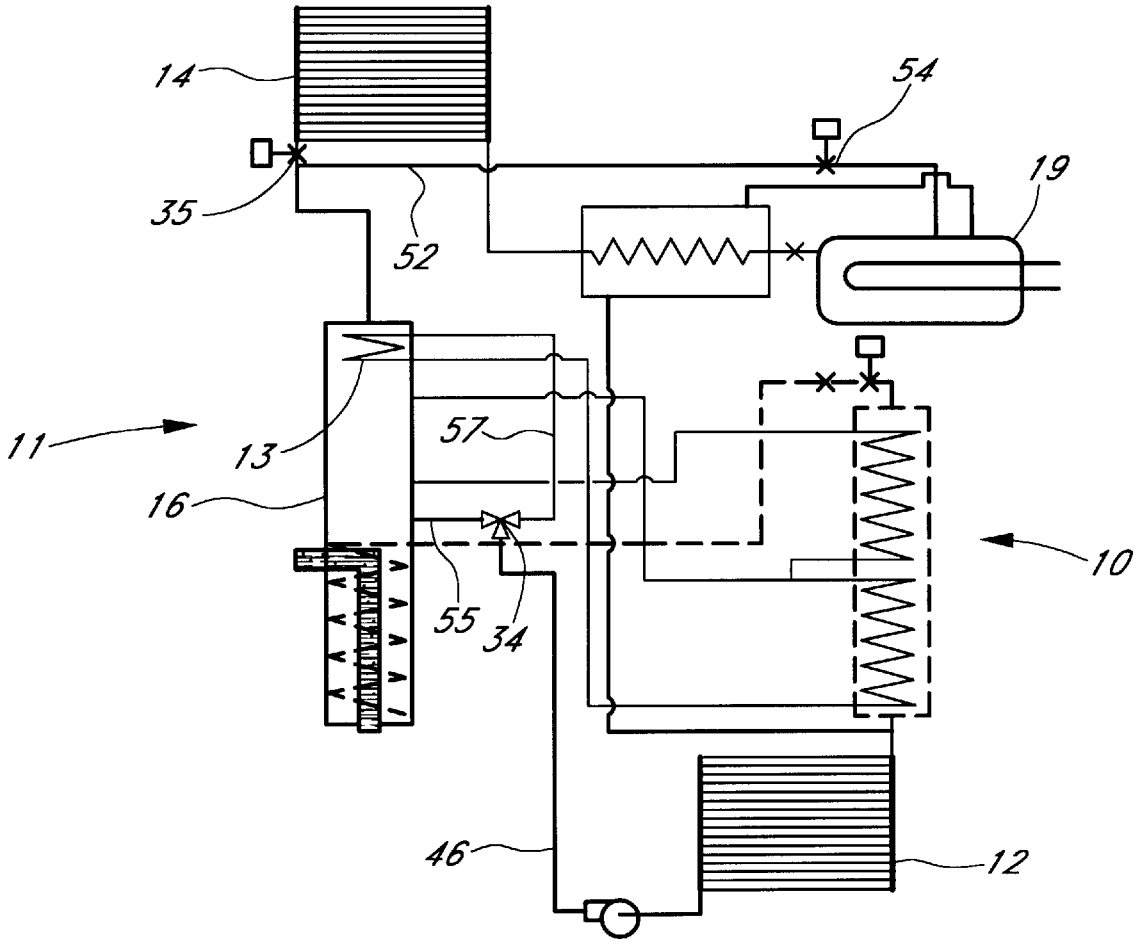
FIG. 4 illustrates an embodiment for controlling solution flow to the generator assembly using a 3-way valve instead of solenoid valves.

FIG. 4 illustrates another alternative embodiment for directing absorption fluid to the generator assembly. In this embodiment, a 3-way valve 34 communicates with pipes 46, 55 and 57 for selectively supplying absorption fluid to reflux coil 13 or to adiabatic section 16 of the generator. Thus, the 3-way valve replaces the two solenoid valves 56, 58 used in the embodiment shown in FIG. 3. Again, as in FIGS. 2 and 3, the bold components and piping illustrate heating mode operation with pumped refrigerant return to the generator.

Figure 5:
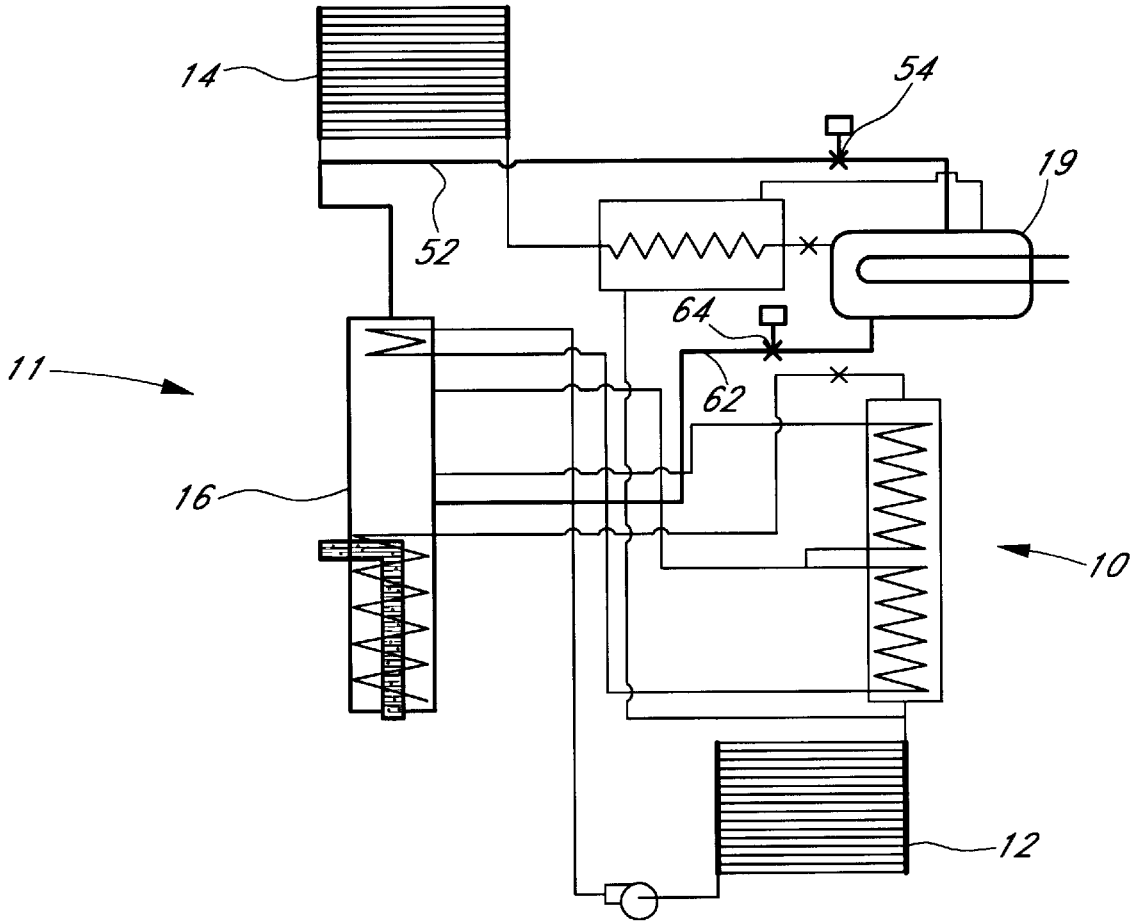
FIG. 5 illustrates another embodiment of the apparatus of the invention in a heating mode using gravity for returning refrigerant to the generator.

In FIG. 5, there is illustrated another embodiment of the integrated chiller/heater system of the present invention. In the embodiment shown, gravity is used for returning the refrigerant from the heat exchanger 19 to the generator 16 via pipe 62 and solenoid operated valve 64, and thus avoids the need for a pump and use of power for operating the pump. Again, in a heating mode of operation, the means for cooling the condenser and absorber are not operated, nor is the absorption fluid pumped through the system. Instead, the refrigerant is simply heated and vaporized in the generator 16, passed directly to the heat exchanger 19 via by-pass pipe 52 where it is condensed for supplying heat to the hot water supply and finally to a load or conditioned space.

In the embodiments illustrated, dual function heat exchanger 19 is described as communicating with an indoor coil for directing the heat from the condenser operation of the heat exchanger, as well as cooling where the heat exchanger operates as an evaporator, via a hydronic loop. However, if presently existing codes regarding the use of ammonia as a refrigerant are relaxed, the coil could be a direct-expansion type indoor coil without the need for a hydronic loop or alternatively, employing other suitable heat transfer fluids including liquid/vapor phase change fluids. As previously noted, the present invention allows for heater functioning of an aqua-ammonia chiller without requiring a second burner or boiler to produce heat for a conditioned space load. Moreover, only one circulating pump is required for the hydronic loop whereas present units having both heater and cooler functions require two pumps, one for chilled water and one for hot water. Because of the reduction in the number of major components and the addition of only solenoid valves and piping, the present invention offers substantial reduction in the cost of aqua-ammonia chiller/heater systems. In the different embodiments illustrated, it is to be understood that different valving and piping for pumped solution to the generator assembly, absorber by-pass and/or refrigerant by-pass between the generator and dual function heat exchanger may be substituted in any of the different apparatus configurations shown. Thus, the different embodiments of the invention illustrated in FIGS. 2–5 may be used to modify the different systems shown in FIGS. 1A–1D within the purview of the invention as will be evident to those skilled in the art.

What is claimed is:

1. An aqua-ammonia absorption apparatus for selective chiller/heater operation comprising:

an absorber assembly comprising an absorber, an absorber heat exchanger and a generator absorber heat exchanger;

a generator assembly;

an absorption fluid loop for directing absorption fluid between said absorber and generator assemblies, said absorption fluid loop comprising first piping for directing rich absorption fluid from said absorber assembly to said generator assembly and second piping for directing weak absorption fluid from said generator assembly to said absorber assembly;

a condenser;

a heat exchanger for selectively functioning as a condenser or an evaporator;

a refrigerant loop for directing refrigerant between said generator assembly, condenser, heat exchanger and absorber assembly; and refrigerant by-pass piping for directing refrigerant from said generator assembly to said heat exchanger without passing through said condenser.

2. An apparatus of claim 1 including a pump cooperating with said first piping for pumping rich absorption fluid from said absorber assembly to said generator assembly.

3. An apparatus of claim 2 including an operable valve cooperating with said second piping for selectively opening and closing said second piping.

4. An apparatus of claim 3 wherein said valve is a solenoid valve.

5. An apparatus of claim 2 wherein said generator assembly comprises a generator and a rectifier and wherein said apparatus includes one or more operable valves cooperating with said first piping for controlling the flow of rich absorption fluid pumped from said absorber assembly to said generator and/or said rectifier, respectively.

6. An apparatus of claim 5 wherein said one or more valves includes a 3-way valve.

7. An apparatus of claim 1 or 5 including one or more operable valves cooperating with said refrigerant by-pass piping for selectively opening and closing said by-pass piping.

8. An apparatus of claim 7 wherein said one or more operable valves comprises a 3-way valve.

9. An apparatus of claim 7 wherein said one or more operable valves comprises a 2-way valve for selectively providing refrigerant to said heat exchanger.

10. An apparatus of claim 9 wherein said 2-way valve is a solenoid valve.

11. An apparatus of claim 9 including an operable valve for selectively providing refrigerant to said condenser.

12. An apparatus of claim 1 wherein said absorption fluid loop directs absorption fluid in heat transfer communication in said absorber heat exchanger and therefrom to said generator assembly.

13. An apparatus of claim 1 wherein said absorption fluid loop directs absorption fluid in heat transfer communication in said absorber heat exchanger and therefrom to said generator absorber heat exchanger and to said generator assembly.

14. An apparatus of claim 12 or 13 wherein said first piping includes a first conduit for directing rich absorption fluid from said absorber to said generator assembly and a second conduit for directing rich absorption fluid from said absorber to a reflux coil in said generator assembly and therefrom to said absorber heat exchanger and therefrom to said generator, a first valve for selectively opening and closing said first conduit, and a second valve for selectively opening and closing said second conduit.

15. An apparatus of claim 14 wherein said first piping includes a third conduit in flow splitting connection with said second conduit for directing rich absorption fluid from said absorber heat exchanger to said generator absorber heat exchanger and therefrom to said generator.

16. An apparatus of claim 14 wherein said second valve opens and closes said second conduit between said absorber and said reflux coil.

17. An apparatus of claim 1 wherein said absorption fluid loop includes an absorption fluid by-pass for directing said absorption fluid from said absorber heat exchanger to said generator assembly without passing through said absorber.

18. An apparatus of claim 17 wherein said absorption fluid by-pass includes piping and one or more operable valves cooperating therewith for selectively directing said absorption fluid to said absorber or to said generator via said absorption fluid by-pass.

19. An apparatus of claim 17 wherein said absorption fluid loop includes an absorption fluid by-pass comprising piping and a 3-way valve cooperating therewith for selectively directing said absorption fluid to said absorber or to said generator.

20. An apparatus of claim 17 wherein said absorption fluid loop includes an absorption fluid by-pass comprising piping and two or more 2-way valves cooperating therewith for selectively directing said absorption fluid to said absorber or to said generator.

21. An apparatus of claim 20 wherein said 2-way valves are solenoid valves.

22. An apparatus of claim 17 wherein said absorber is air-cooled.

23. An apparatus of claim 17 wherein said absorber is water cooled.

24. An apparatus of claim 1 including a refrigerant conduit for directing refrigerant from said heat exchanger to said generator assembly and a valve for selectively opening and closing said refrigerant conduit.

25. An apparatus of claim 22 wherein said heat exchanger is elevated above said generator assembly to provide gravity flow of condensed refrigerant from said heat exchanger to said generator assembly via said refrigerant conduit.

26. An apparatus of claim 25 including one or more operable valves cooperating with said refrigerant by-pass piping for selectively opening and closing said by-pass piping.

27. An apparatus of claim 25 wherein said one or more operable valves comprises a 3-way valve.

28. An apparatus of claim 25 wherein said one or more operable valves comprises a 2-way valve for selectively providing refrigerant to said heat exchanger.

29. An apparatus of claim 1 including heat transfer fluid piping for directing heat transfer fluid to and from said heat exchanger.

30. An apparatus of claim 1 wherein said heat exchanger includes a direct-expansion-type air coil and means for recovering heating or cooling comprising apparatus for exchanging heating or cooling from said coil.

31. An apparatus of claim 1 including heat transfer apparatus cooperating with said heat exchanger for recovering cooling or heating when said heat exchanger functions as an evaporator or condenser, respectively.

32. An aqua-ammonia absorption apparatus for selective chiller/heater mode operation comprising an absorber assembly comprising an absorber, an absorber heat exchanger and a generator absorber heat exchanger, a generator assembly, an absorption fluid loop for directing absorption fluid between said absorber assembly and said generator assembly and directing absorption fluid in heal transfer communication in said absorber heat exchanger and therefrom to said generator assembly, a condenser, a heat exchanger for selectively functioning as an evaporator during a chiller mode and as a condenser during a heater mode, and refrigerant piping and one or more valves cooperating therewith for selectively directing ammonia refrigerant vaporized in said generator assembly to said heat exchanger without passing through said condenser during a heater mode.

33. An apparatus of claim 32 wherein said refrigerant piping comprises by-pass piping and one or more valves cooperating therewith for selectively opening and closing said by-pass piping.

34. An apparatus of claim 32 including energy recovery means cooperating with said heat exchanger for recovering cooling when said heat exchanger functions as an evaporator and for recovering heat when said heat exchanger functions as a condenser.

35. An apparatus of claim 33 including energy recovery means cooperating with said heat exchanger for recovering cooling when said heat exchanger functions as an evaporator and for recovering heat when said heat exchanger functions as a condenser.

36. An apparatus of claim 34 wherein said energy recovery means comprises apparatus for directing heat exchange fluid to and from said heat exchanger.

37. An apparatus of claim 33 wherein said absorber assembly comprises an absorber and an absorber heat exchanger and wherein said absorption fluid loop directs absorption fluid in heat transfer communication in said absorber heat exchanger and therefrom to said generator assembly, and a pump cooperating with said absorption fluid loop for pumping absorption fluid therein.

38. An apparatus of claim 33 wherein said absorption fluid loop includes a first conduit for directing rich absorption fluid from said absorber to said generator assembly and a second conduit for directing rich absorption fluid from said absorber in sequence to a reflux coil in said generator assembly, to said absorber heat exchanger and to said generator assembly, a first valve for selectively opening and closing said first conduit, and a second valve for selectively opening and closing said second conduit.

39. An apparatus of claim 38 wherein said absorber assembly includes a generator absorber heat exchanger and wherein said absorption fluid loop includes a third conduit in flow splitting connection with said second conduit for directing rich absorption fluid from said absorber heat exchanger in sequence to said generator absorber heat exchanger and to said generator assembly.

40. An apparatus of claim 38 wherein said second valve opens and closes said second conduit between said absorber and said reflux coil.

41. An apparatus of claim 39 wherein said absorption fluid loop includes a weak solution conduit from said generator assembly and said absorber assembly and a valve for selectively closing and opening said weak solution conduit.

42. An apparatus of claim 32 wherein said one or more valves comprises a 3-way valve for selectively directing said refrigerant from said generator assembly to said condenser and said heat exchanger.

43. An apparatus of claim 42 including a first refrigerant pipe for directing refrigerant from said 3-way valve to said condenser and a second refrigerant pipe for directing refrigerant from said 3-way valve to said heat exchanger.

44. An apparatus of claim 32 wherein said heat exchanger is positioned relative to said generator assembly to provide for gravitational flow of condensed refrigerant from said heat exchanger to said generator assembly.

45. An apparatus of claim 1 or 38 including a pump operable for pumping said rich absorption fluid from said absorber assembly to said generator assembly for chiller mode operation and/or pumping refrigerant to the generator assembly during heater mode operation.

46. An apparatus of claim 45 wherein said generator assembly comprises a generator and a rectifier, wherein said first piping directs rich absorption fluid from said absorber assembly to said rectifier, and wherein said pump operates to directs said rich absorption fluid from said absorber assembly to said rectifier in a heating mode.

47. An apparatus of claim 45 wherein said generator assembly comprises a generator and a rectifier, wherein said first piping directs rich absorption fluid from said absorber assembly to said generator, and wherein said pump operates to direct said rich absorption fluid from said absorber assembly to said generator in a heating mode.

48. An apparatus of claim 2 wherein said generator assembly comprises a generator and a rectifier, wherein said first piping directs rich absorption fluid from said absorber assembly to said rectifier, and wherein said pump operates to directs said rich absorption fluid from said absorber assembly to said rectifier in a heating mode.

49. An apparatus of claim 3 wherein said generator assembly comprises a generator and a rectifier, wherein said first piping directs rich absorption fluid from said absorber assembly to said generator, and wherein said pump operates to direct said rich absorption fluid from said absorber assembly to said generator in a heating mode.

50. An apparatus of claim 1 or 32 including a subcooler cooperating with said refrigerant loop for receiving condensed and vaporized refrigerant and exchanging heat therebetween.

51. An apparatus of claim 1 or 32 wherein said generator assembly includes a multiple capacity burner.

52. An apparatus of claim 1 or 32 wherein said generator assembly includes a variable capacity burner.

53. An apparatus of claim 1 or 32 wherein said generator assembly includes having a combustion air pre-heater.

54. An apparatus of claim 1 or 32 including a generator absorber heat exchange circuit comprising said absorber heat exchanger and said generator absorber heat exchanger and utilizing rich absorption fluid, weak absorption fluid or heat transfer fluid for heat exchange in said circuit.

55. An apparatus of claim 54 wherein said generator absorber heat exchange circuit directs rich absorption fluid to said absorber heat exchanger and to said generator absorber heat exchanger and includes a flow splitter for dividing the flow of rich absorption fluid between said absorber heat exchanger and said generator absorber heat exchanger before said rich absorption fluid is directed into said absorber heat exchanger.

56. An apparatus of claim 54 wherein said generator absorber heat exchange circuit directs rich absorption fluid to said absorber heat exchanger and to said generator absorber heat exchanger and includes a flow splitter for dividing the flow of rich absorption fluid after it passes through said absorber heat exchanger.

57. An apparatus of claim 33 or 32 wherein said refrigerant piping and one or more valve operate to selectively prevent the flow of refrigerant from said generator assembly to said condenser.

58. An apparatus of claim 1 wherein said apparatus includes absorber by-pass piping and valving for directing refrigerant and/or absorption fluid for by-passing the absorber.

59. An apparatus of claim 58 including a pump cooperating with said absorber by=pass piping for pumping the refrigerant and/or absorption fluid to the generator assembly.

60. An apparatus of claim 17 wherein said refrigerant loop includes piping cooperating with said absorption fluid by-pass for directing said refrigerant from said heat exchanger to said generator assembly without passing through said absorber.

61. An apparatus of claim 60 including a pump cooperating with said absorption fluid by-pass for pumping absorption fluid and refrigerant to the generator.

62. An apparatus of claim 32 including piping and valving for selectively directing refrigerant and/or absorption fluid for by-passing the absorber during a heater mode.

63. An aqua-ammonia absorption apparatus for selective chiller/heater operation comprising:

an absorber assembly comprising an absorber, an absorber heat exchanger and a generator absorber heat exchanger;

a generator assembly;

an absorption fluid loop and a single pump cooperating therewith for directing absorption fluid and refrigerant between said absorber and generator assemblies and for directing absorption fluid in heat transfer communication in said absorber heat exchanger and said generator absorber heat exchanger, said absorption fluid loop comprising first piping for directing absorption fluid and refrigerant from said absorber assembly to said generator assembly and second piping for directing weak absorption fluid from said generator assembly to said absorber assembly;

a condenser;

a heat exchanger for selectively functioning as a condenser or an evaporator;

refrigerant loop for directing refrigerant between said generator assembly, condenser, heat exchanger and absorber assembly; and refrigerant by-pass piping for directing refrigerant from said generator assembly to said heat exchanger without passing through said condenser.

64. An apparatus of claim 63 wherein said single pump cooperates with said first piping for pumping rich absorption fluid and refrigerant from said absorber assembly to said generator assembly.

65. An apparatus of claim 64 including operable valve cooperating with said second piping for selectively opening and closing said second piping.

66. An apparatus of claim 63 including one or more operable valves cooperating with said refrigerant by-pass piping for selectively opening and closing said by-pass piping.

67. An apparatus of claim 63 wherein said absorption fluid loop directs absorption fluid in heat transfer communication in said absorber heat exchanger and therefrom to said generator assembly.

68. An apparatus of claim 63 wherein said absorption fluid loop directs absorption fluid in heat transfer communication in said absorber heat exchanger and therefrom to said generator absorber heat exchanger and to said generator assembly.

69. An apparatus of claim 67 or 68 wherein said first piping includes a first conduit communicating with said generator assembly and a second conduit communicating with a reflux coil in said generator assembly, a first valve for selectively opening and closing said first conduit, and a second valve for selectively opening and closing said second conduit.

70. An apparatus of claim 69 wherein said first piping includes a third conduit in flow splitting connection with said second conduit for directing absorption fluid from said absorber heat exchanger to said generator absorber heat exchanger and said generator.

71. An apparatus of claim 63 including absorber by-pass piping for directing absorption fluid or refrigerant to said generator assembly without passing through said absorber.

72. An apparatus of claim 71 wherein said absorber by-pass includes piping and one or more operable valves cooperating therewith for selectively by-passing said absorber.

* * * * *